US009091157B2

(12) United States Patent
Ndinemenu et al.

(10) Patent No.: US 9,091,157 B2
(45) Date of Patent: Jul. 28, 2015

(54) METHOD FOR EXTRACTING HYDROCARBONS FROM A TANK AND HYDROCARBON EXTRACTION FACILITY

(75) Inventors: Félix Ndinemenu, Pau (FR); Pierre Lemetayer, Pau (FR); Emmanuel Toguem Nguete, Pau (FR)

(73) Assignee: TOTAL S.A., Courbevoie (FR)

( * ) Notice: Subject to any disclaimer, the term of this patent is extended or adjusted under 35 U.S.C. 154(b) by 691 days.

(21) Appl. No.: 13/265,788

(22) PCT Filed: Apr. 22, 2010

(86) PCT No.: PCT/IB2010/051774

§ 371 (c)(1),
(2), (4) Date: Oct. 21, 2011

(87) PCT Pub. No.: WO2010/122516

PCT Pub. Date: Oct. 28, 2010

(65) Prior Publication Data

US 2012/0048546 A1 Mar. 1, 2012

(30) Foreign Application Priority Data

Apr. 23, 2009 (FR) ..... 09 01969

(51) Int. Cl.
*E21B 43/24* (2006.01)

(52) U.S. Cl.
CPC ..... *E21B 43/24* (2013.01)

(58) Field of Classification Search
CPC ..... E21B 34/066; F04B 49/20
USPC ..... 166/272.3, 313
See application file for complete search history.

(56) References Cited

U.S. PATENT DOCUMENTS

| | | | | |
|---|---|---|---|---|
| 4,116,275 | A | 9/1978 | Butler et al. | |
| 4,332,401 | A | 6/1982 | Stephenson et al. | |
| 4,344,485 | A * | 8/1982 | Butler | 166/271 |
| 4,415,184 | A | 11/1983 | Stephenson et al. | |
| 4,512,721 | A | 4/1985 | Ayres et al. | |
| 6,230,814 | B1 * | 5/2001 | Nasr et al. | 166/400 |
| 7,448,447 | B2 | 11/2008 | Walford | |
| 2007/0199696 | A1 * | 8/2007 | Walford | 166/250.01 |
| 2010/0200223 | A1 | 8/2010 | Mauduit et al. | |
| 2010/0282642 | A1 | 11/2010 | Kan | |
| 2011/0005751 | A1 | 1/2011 | Audibert-Hayet | |

FOREIGN PATENT DOCUMENTS

| | | |
|---|---|---|
| CA | 1304287 | 6/1992 |
| FR | 2 858 314 | 2/2005 |
| WO | WO 2008/079799 | 7/2008 |

*Primary Examiner* — Angela M DiTrani
*Assistant Examiner* — Ashish Varma
(74) *Attorney, Agent, or Firm* — Harness, Dickey & Pierce, P.L.C.

* cited by examiner

(57) ABSTRACT

The disclosure relates to a method for extracting hydrocarbons from a tank including providing a facility having an injection well including at least one tube for steam injection, a production well including at least one hydrocarbon extraction tube, a set of measuring sensors, at least one hydrocarbon extracting pump in the production well, an automaton for controlling and monitoring the running of the facility; rejecting the steam into the injection well; extracting the hydrocarbons with the pump of the production well; and controlling speed of the pump depending on the difference between the measured temperature at the pump input and the evaporation temperature calculated on the basis of the measured pressure at the input of the pump. The method enables an increase in hydrocarbon production.

14 Claims, 2 Drawing Sheets

METHOD FOR EXTRACTING HYDROCARBONS FROM A TANK AND HYDROCARBON EXTRACTION FACILITY

CROSS-REFERENCE TO RELATED APPLICATIONS

This application is a National Phase Entry of International Application No. PCT/IB2010/051774, filed on Apr. 22, 2010, which claims priority to French Patent Application Serial No. 0901969, filed on Apr. 23, 2009, both of which are incorporated by reference herein.

BACKGROUND AND SUMMARY

The present invention relates to a method for extracting hydrocarbons from a tank and a hydrocarbon extraction facility.

The tank in question can include viscous oils. Traditionally, using the definitions of the US Geological Survey, heavy oil refers to an oil whereof the density is less than 22° API and the viscosity of which is greater than 100 cP, extra heavy oil refers to an oil whereof the density is less than 10° API and the viscosity of which is greater than 100 cP, and tar sands refers to an oil having a density between 7° API and 12° API and the viscosity of which is greater than 10,000 cP.

The viscosity of an oil varies on the basis of the pressure and temperature to which it is subjected. Thus, the more the temperature increases, the more the viscosity of the oil decreases. In situ viscosity refers to the viscosity of an oil under the pressure and temperature conditions encountered in the tank.

Only oils with a low enough in situ viscosity can be produced by "cold" pumping. These oils are qualified as mobile oils. Beyond a certain viscosity, and in particular for the viscosity values encountered for heavy oils, extra heavy oils and tar sands, other methods must be used, such as thermal methods that consist of injecting steam into the tank. The latent heat of the steam is transferred to the tank by condensation of the steam. The temperature increase of the tank decreases the viscosity of the oil, and consequently facilitates its mobility in the tank.

SAGD (Steam Assisted Gravity Drainage) is a method for the thermal recovery of oils with little or no mobility resting on the gravitational drainage mechanism. Applicable for heavy oils, extra-heavy oils and tar sands, the SAGD method uses a set of pairs of horizontal wells distributed relatively regularly in the tank. "Pair of wells" refers to a steam injection well drilled approximately 5 m greater than a production well. Each well is several hundred meters long, and each pair is typically spaced apart from the following pair by 100 to 150 m. The steam is injected continuously into the upper well (or injection well), developing a steam chamber around the injection well. The condensed oil and steam flow gravitationally along the walls of the steam chamber, as far as the lower well, from which they are extracted by pumping. To extract tar sands, an initial preheating phase of the tank by circulating steam in both wells is necessary to ensure communication between the two wells. SAGD is in particular described in patent application CA1130201.

Steering SAGD wells involves acting both on the production well (for example by acting on the speed of rotation of the pump) and on the injection well (by acting on the steam injection flow rates). Furthermore, in SAGD, since the development of the steam chamber is done gradually, the hydrocarbon production is not done continuously; i.e. the flow rate of the hydrocarbons is not constant at the pump. The bottom hole pressure is highly variable and unpredictable. However, the pressure in the tank must never exceed a threshold pressure, in general the fracturation pressure. It is therefore important to control the pressure in the tank in real-time.

Furthermore, regarding the fields developed in the North of Canada, therefore with very low temperatures in the winter, manual steering of the wells is very difficult to do. For these reliability and safety reasons, it is desirable to propose a method for automatically steering SAGD wells, during the production phase. Application WO2008079799 describes a hydrocarbon extraction method, where the opening of a valve is adjusted automatically on the basis of a measured physical parameter (for example the presence of sand). There are no known automation devices for SAGD during the production phase, or during the circulation phase.

There is therefore a need for a hydrocarbon extraction method, in particular in the form of a heavy oil, that is efficient. To that end, the invention proposes a method for extracting hydrocarbons from a tank including providing a facility including an injection well including at least one tube for steam injection a production well including at least one hydrocarbon extraction tube a set of measuring sensors at least one hydrocarbon extracting pump in the production well, an automaton for controlling and monitoring the running of the facility the injection of steam into the injection well, the extraction of hydrocarbons by the pump of the production well, the control of the speed of the pump on the basis of the difference between the measured temperature at the input of the pump and the evaporation temperature calculated on the basis of the measured pressure at the input of the pump.

According to one alternative, the method also includes keeping a set of parameters in a predetermined threshold value range by adjusting the speed of rotation of the pump in the production well and/or adjusting the steam injection flow rate in the injection well.

According to one alternative, one controlled parameter is the pressure in the tank at the injection well, the method also including modifying the injection flow rate of the steam in the injection well. According to one alternative, one controlled parameter is the temperature difference, at a point along the production well, between the temperature of the fluids in the production well at that point and the evaporation temperature calculated on the basis of the pressure at that point, the method comprising adjusting the steam injection flow rate in the injection well on the basis of the controlled parameter.

According to one alternative, the injection well comprises at least two steam injection tubes. According to one alternative, the facility also comprises temperature sensors, and the production well comprises a substantially vertical portion and a substantially horizontal portion whereof the end is the toe of the production well, the portions being connected by a heel, one controlled parameter is the difference between the temperature measured at the heel of the production well and the temperature measured at the toe of the production well, the method also comprising adjusting the injection distribution of the steam between the two tubes of the injection well. According to one alternative, the facility comprises temperature sensors in the injection well, the method comprising adjusting the injection distribution of the steam by the injection tubes of the injection well on the basis of the temperature profiles obtained at the injection well.

According to one alternative, one controlled parameter is also the pressure in the annular space around the extraction tube of the production well, the method also comprising actuating a ventilation choke of the annular space and/or varying the speed of rotation of the pump on the basis of the controlled parameter. According to one alternative, one controlled parameter is also the power consumed by the pump, the method including varying the speed of rotation of the pump on the basis of the controlled parameter. According to one alternative, one controlled parameter is also the torque exerted on the pump, calculated by the automaton on the basis of the speed of rotation of the pump and the power consumed by the pump, the method including varying the speed of rotation of the pump on the basis of the controlled parameter.

According to one alternative, the injection well includes two steam injection tubes each having a steam injection valve, the facility also comprising flow or pressure sensors situated on the surface at the steam injection valves of the first and second tubes of the injection well, the method including:

comparing the measured flow rates to parameterized minimum flow values, and triggering an alarm and/or stopping the facility if the measured values are lower than the parameterized values.

According to one alternative, the injection well comprises two steam injection tubes each with a steam injection valve, the facility also including flow or pressure sensors situated on the surface at the steam injection valves of the first and second tubes of the injection well, the method including comparing the measured flow rates to parameterized maximum flow values, and reducing the steam injection flow rate if the measured pressure is greater than the parameterized maximum pressure.

According to one alternative, one controlled parameter is also the difference between the pressure measured upon suction of the pump and a parameterized threshold pressure, the method comprising triggering an alarm, and/or varying the speed of rotation of the pump on the basis of the controlled parameter. According to one alternative, one controlled parameter is also the speed of decrease of the pressure upon suction of the pump, the method comprising triggering an alarm, and/or varying the speed of rotation of the pump on the basis of the controlled parameter.

The invention also relates to a facility including an injection well including at least one steam injection tube, a production well including a hydrocarbon extraction tube, a set of measuring sensors at least one pump for extracting hydrocarbons in the production well, an automaton for controlling and monitoring the running of the facility, the automaton being adapted to control the speed of the pump on the basis of the difference between the temperature measured at the input of the pump and the evaporation temperature calculated on the basis of the pressure measured at the input of the pump.

According to one alternative, the injection and production wells are substantially parallel. According to one alternative, the injection well comprises first and second steam injection tubes, the first tube being shorter than the second tube and the tubes being concentric.

BRIEF DESCRIPTION OF THE DRAWINGS

Other features and advantages of the invention will appear upon reading the following detailed description of embodiments of the invention, provided solely as an example and in reference to the drawings, which show.

DETAILED DESCRIPTION

The invention relates to a method for extracting hydrocarbons from a tank using a facility including an injection well and a production well. A pump in the production well makes it possible to extract the hydrocarbons. The method includes controlling the speed of the pump on the basis of the difference between the evaporation temperature of the water calculated at the pressure measured at the input of the pump and the temperature measured at the input of the pump. This makes it possible to optimize the speed of the pump in real-time, so as to continuously ensures optimal operating conditions. Furthermore, this makes it possible to make the extraction method more efficient and to increase the hydrocarbon production.

Figure 1:
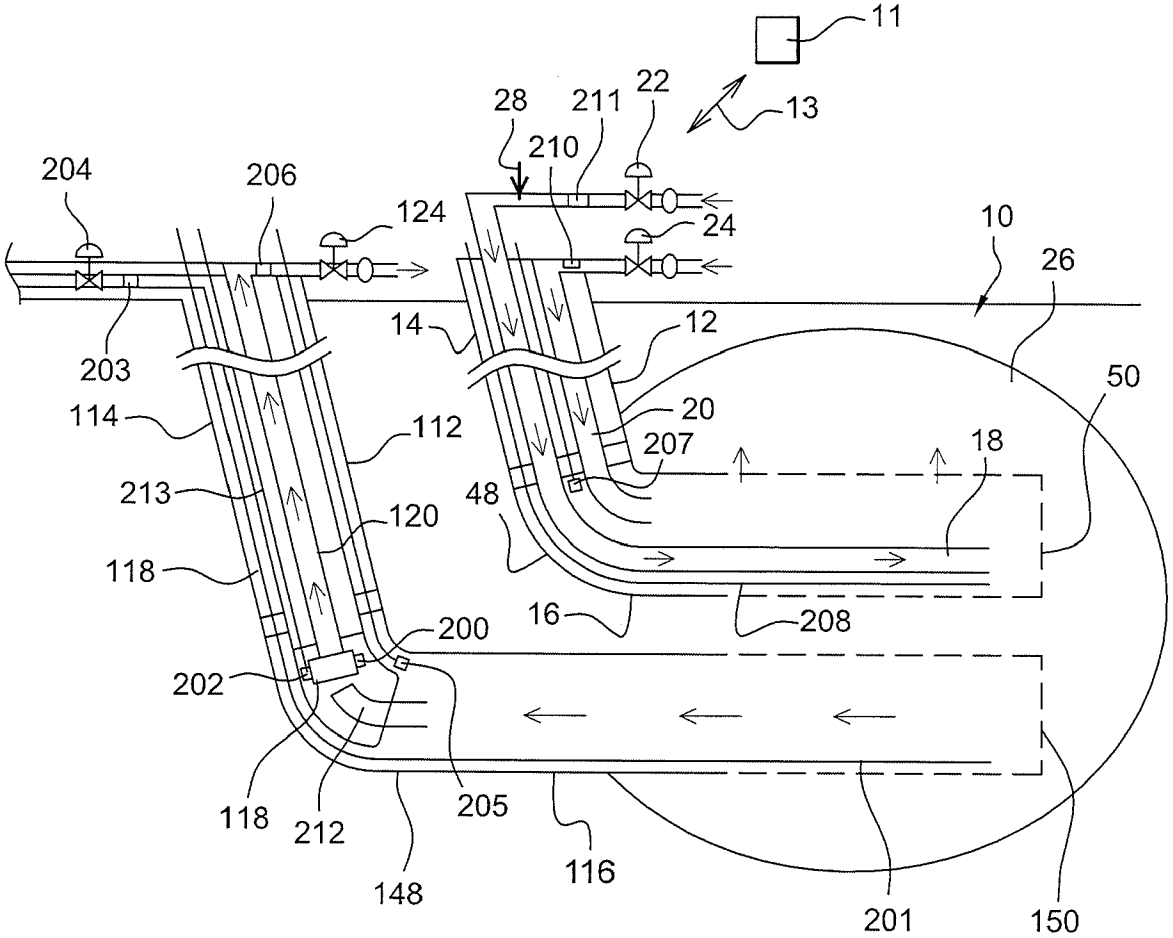
FIG. 1, a diagrammatic view of a facility according to the invention. In this facility, the upper well comprises two parallel tubes, the lower well comprises a single tube with which a pump is associated.

FIG. 1 shows a tank 10 with two wells 12, 112. The first well 12 is a steam injection well and the second well 112 is a hydrocarbon production well. The production well 112 is situated lower in the tank than the injection well 12. The wells 12 and 112 are for example approximately 5 to 8 meters apart.

The underground tank 10 contains hydrocarbons with little or no mobility, such as for example heavy oils, extra-heavy oils or tar sands. Each well comprises two ends, an upper end situated on the surface and a lower end situated in the tank. The well also comprises two distinct portions, i.e. a portion 14, 114 that is vertical or slightly inclined relative to the vertical, connected to the upper end of the well and a portion 16, 116 that is substantially horizontal and connected to the lower end of the well. A junction or heel 48, 148 makes it possible to connect the substantially vertical portions 14, 114 to the substantially horizontal portions 16, 116. The portion of the substantially vertical well 14, 114 is covered with a continuous casing. The substantially horizontal portion 16, 116 is covered with a broken casing, i.e. having perforations allowing, for the injection well 12, the passage of steam from the injection well toward the tank and for the production well, the passage of hydrocarbons from the tank toward the inside of the production well 112. It is also possible to consider a well having a different architecture, with a single substantially horizontal part 16, 116 when the ground is sloped.

The well 12 can comprise a single steam injection tube. The well 12 can comprise two tubes: a first injection tube 18 and a second injection tube 20. The geometry of the tubes can vary. According to the example of FIG. 1, the two tubes are parallel to one another. The first tube 18 extends from the upper end of the injection well 12 to the lower end of the injection well 12, also called toe 50. The second tube 20 extends from the upper end of the injection well 12 to the area around the heel connecting the portions 14 and 16. The first tube 18 is therefore longer than the second tube 20. Steam can be injected into the two injection tubes 18, 20. Due to the difference in length of the tubes 18 and 20, the steam is injected both into the heel 48 and the toe 50 of the injection well 12 toward the tank, which ensures a good distribution of the steam in the area of the tank situated near the horizontal portion of the injection well 12.

Figure 2:
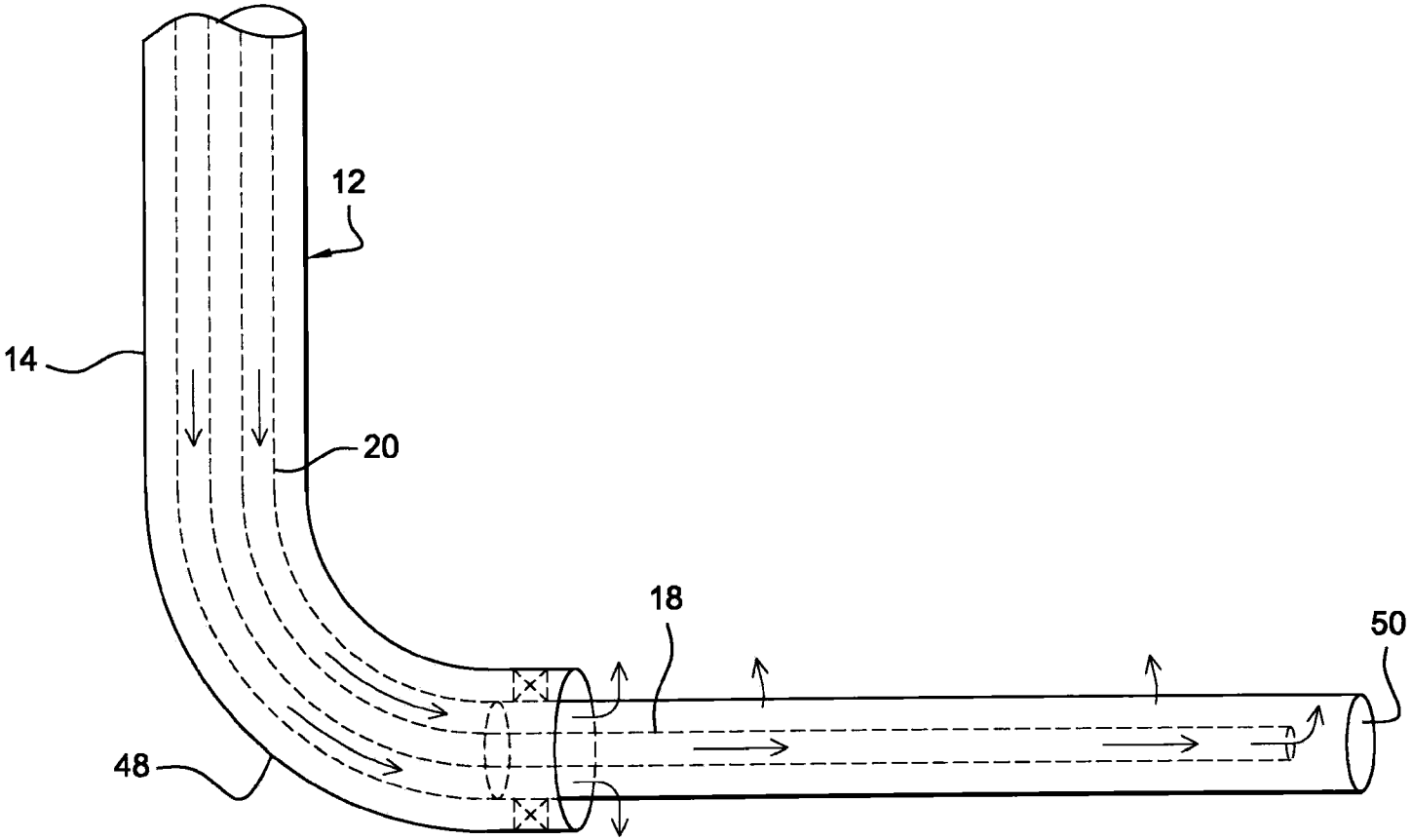
FIG. 2 is a diagrammatic view of the upper well of another facility according to the invention, the upper well comprising two concentric tubes.

Another well architecture is shown in FIG. 2. For that architecture, the injection tubes 18, 20 are concentric. For example, the tube 18, the end of which is located at the lower end of the injection well 12, is situated in the tube 20 whereof the lower end is located at the heel. The tube 18 therefore extends beyond the tube 20.

In another well architecture, the injection well 12 only comprises a single tube 18, the lower end of which is situated at two-thirds of the distance separating the heel from the lower end of the well 12. Perforations are provided in the tube 18 between the heel and the lower end of the tube 18, so as to allow steam to be injected in the tank and the steam chamber to develop.

The tubes 18, 20 of the injection well 12 are equipped with chokes 22, 24 that make it possible to control the steam injection flow. Thus, the choke 22 makes it possible to control the injection flow rate in the tube 18, and the choke 24 makes it possible to control the injection flow rate in the tube 20. The opening of the chokes 22 and 24 is adjustable, which makes to possible to precisely adjust the flow rate in the tubes 18, 20. The adjustable opening of the chokes makes it possible to increase or reduce the degree of opening, which allows continuous control of the chokes. Thus, rather than opening the chokes level by level, sequentially, the chokes are controlled continuously by opening or closing depending on the reaction by the well.

In one embodiment, the injection well 12 is equipped with a pressure sensor 207, which measures the pressure at the heel 48 of the injection well. This may involve a direct sensor, an off-board sensor of the bubble type or a virtual sensor. In that case, the pressure is in fact calculated from the pressure value measured on the surface by the sensors 210, 211, situated on the surface downstream of the chokes 24, 22. In the diagram of FIG. 1, the pressure sensor 207 is shown in the form of a bubble sensor. Another pressure sensor may potentially be situated at the toe of the injection well (not shown in FIG. 1).

In one particular embodiment, temperature sensors 208 are installed in the injection well 12. These may for example be sensors in the form of optical fiber deployed in the well and clamped on the tube 18.

The production well 112 comprises a tube 120 via which the hydrocarbons extracted from the tank are conveyed toward the surface. The upper end of the extraction tube 120 is situated on the surface, the lower end of the extraction tube 120 is situated at the heel 148 or more in front of the lower well, such as for example midway between the heel 148 and the lower end 150 of the production well. Perforations can be provided along the extraction tube 120, with a bypass system, to control the distribution of the draw-off along the drain. The lower end of the extraction tube 120 is submerged in the hydrocarbons coming from the tank and having penetrated in a production well 112 along the entire substantially horizontal portion 116. A choke 124 situated on the tube 120 at the upper end of the well makes it possible to control the hydrocarbon flow rate, in particular to prevent the appearance of plugs at the surface facilities.

Pumping means 118 are provided in the production well 112, such as for example a progressive cavity pump. Alternatively, an ESP or "twin screw" pump can be used. The pump is situated on the tube 120, at the heel 148. The pump is submerged in hydrocarbons, which makes it possible to convey the hydrocarbons toward the surface via the tube 120. A check valve 212 is provided on the tube 120, so as to prevent the hydrocarbons from returning toward the horizontal portion of the tube 120. The pump is equipped with a variable speed drive. A power sensor can also be provided at the power supply of the pump.

The production well 112 is also equipped with temperature sensors. These temperature sensors measure the temperature of the fluids circulating in the lower well 112. A temperature sensor 200 is situated at the pump, outside the tube 120. In one particular embodiment, other temperature sensors are also provided, preferably in the form of an optical fiber 201 deployed in the production well, which makes it possible to establish the temperature profiles along the well. The temperature of the fluids present in the well is thus measured from the surface to the lower end of the production well 12.

The facility can also comprise pressure sensors, intended to measure the pressure at the production well 112. In particular, a sensor 202 is provided at the input of the pump in the production well 112. A pressure sensor 205 can also be provided to measure the pressure at the heel 148, outside the tube 120. Another pressure sensor may potentially be installed at the toe 150 of the production well 112. These pressure sensors can be of several types: this may involve a direct pressure sensor, for example of the electronic sensor type. These may be off-board sensors, of the bubble type. For this type of sensor, a low-flow fluid is blown into a capillary tube, and the pressure is measured on the surface. In FIG. 1, the sensors 202 and 205 are shown in bubble form.

Alternatively, in the absence of pressure sensors, a virtual sensor may be used. This involves an algorithm on the basis of the geometry of the well and physico-chemical properties of the fluids circulating in the well, and the pressure measured on the surface by the sensor 206, situated upstream of the choke 124 will make it possible to calculate the pressure at the bottom of the well. In that case, the pressure measured by the virtual sensor is in fact an estimated pressure. Pressure sensors are also provided on the surface. A pressure sensor 203 thus measures the pressure in the annulus 213, upstream of the annular ventilation choke 204.

The facility is provided with an automaton 11 making it possible to control and monitor the running of the facility. In particular, the automaton 11 is connected to the different elements of the facility. For example, the automaton 11 can send signals to the chokes and receive signals from the sensors. For increased clarity, the connection between the automaton and the various elements of FIG. 1 is diagrammed by an arrow 13. The automaton 11 can act both on the speed of rotation of the pump 118 and on the steam injection flow rates at the injection well 12.

The hydrocarbon extraction method will now be presented. The extraction method takes place once the steam chamber 26 has developed in the tank, as explained by the example in application FR 08 07 374 dated Dec. 22, 2008 filed by the applicant of this application. Once the viscosity of the hydrocarbons has decreased enough for the oil to become mobile and flows into the lower well 112, the steam injection is stopped in the well 112. The equipment of the well 112 is also modified. Thus, if the well 112 comprises two tubes, one of the two tubes will be removed from the well, preferably the longest tube. A pump device 118 is installed in the well 112, as well as a set of sensors, in particular temperature sensors and possibly pressure sensors. The well 112 becomes a production well, making it possible to extract hydrocarbons from the tank toward the surface via the tube 120.

The extraction method then consists of continuously injecting steam into the tank via tubes 18 and 20 of the injection well 12. The viscosity of the hydrocarbons situated in the development zone of the steam chamber decreases, which allows them to be recovered at the production well 112, situated lower in the tank.

The method according to the invention also includes controlling the speed of the pump on the basis of the difference between the evaporation temperature of the water calculated at the pressure measured in the production well at the input of the pump and the temperature measured at the input of the pump. The evaporation temperature of the water is the temperature at which the water goes from the liquid state to the vapor state. The evaporation temperature is known for a given pressure. The difference between the evaporation temperature of the water calculated at the pressure measured in the production well at the pump and the temperature measured in the production well at the pump is called the subcool pump.

The temperature sensor 200 continuously measures the temperature at the pump, and the pressure sensor 202 measures the pressure at the input of the pump. In the event of failure of the sensor 200 for the temperature measured at the pump by the optical fiber sensor 201 may be taken into account by the automaton to calculate the subcool pump.

The suction pressure of the pump is measured either directly by a sensor, or indirectly by a bubble-type sensor, or by a virtual sensor, i.e. from the surface pressure measured by the sensor 206. From the pressure value measured at the suction of the pump, the automaton calculates the evaporation temperature. From that value and the temperature measured at the input of the pump, the automaton will then calculate the subcool pump value. In the event of failure of the sensor 202, the automaton may calculate the subcool pump from pressure values measured by the sensor 205, i.e. the pressure value measured in the drain at the heel 148.

Continuously (in real time), the automaton compares the subcool pump value thus calculated to a value parameterized by the people in charge of the facility. This parameterized value will be in a state of equilibrium typically between 1° C. and 10° C., preferably between 2° and 5°, with a tolerance in the vicinity of 1° to 2° C. If the subcool pump value is greater than the parameterized value, the automaton will act on the variable speed drive of the pump so as to increase the speed of the pump. If the subcool pump value is lower than the parameterized value, the automaton will act on the variable speed drive so as to decrease the speed of the pump. By acting on the variable speed drive of the pump, one acts on the suction pressure of the pump and therefore on the anticipated value of the evaporation temperature, since the latter is known for a given pressure. For proper running of the facility, it is in fact important to prevent steam from being present upon suction of the pump: in fact, even if the pumps traditionally used can pump a mixture of oil and gas (at a reduced percentage), pumping a mixture of oil and steam can be very damaging.

The method also consists of keeping a set of parameters within a range of predetermined threshold values by adjusting the speed of rotation of the pump in the production well and/or adjusting the steam injection flow rate in the injection well. This makes it possible not to move away from optimal operating conditions of the pump. The speed of rotation of the pump and/or the steam injection rate are adjusted continuously so that the set of controlled parameters does not move away from the threshold values parameterized by the people in charge of exploiting the well.

For example, one of the continuously-measured physical parameters is the pressure in the tank at the injection well. The pressure is continuously measured at the heel 48 of the injection well, owing to a sensor 207, or calculated from pressure valves measured on the surface by the sensors 210, 211, situated upstream of the chokes 24, 22. The automaton compares these values to threshold pressure values, parameterized by the people in charge of the facility. These threshold pressure values correspond to the fracturation pressures. The steam flow rate is continuously adjusted so as to come closer to said threshold pressure values. Thus, if the value measured or calculated at the heel is lower than the parameterized threshold pressure value, the automaton will act on the steam injection valve 24 of the tube 20 so as to increase the steam injection flow rate at the heel 48 of the injection well 12. Conversely, if the value measured or calculated at the heel 48 is greater than the parameterized threshold pressure value, the automaton will act on the steam injection valve 24 so as to decrease the steam injection flow rate. In the event the upper well is equipped with a pressure sensor measuring or calculating the pressure at the toe, the same operation is repeated for the pressure values measured or calculated at the toe 50. The automaton will then act on the steam injection valve 22 of the tube 18.

Another controlled parameter is the difference between the evaporation temperature calculated at the pressure measured in the tank and the temperature of the fluids measured in the tank. This parameter is called the subcool tank. From the temperature and pressure values measured at certain points at the production well by the sensors 201, 202 and 205 the automaton continuously calculates the subcool tank values at the toe 150 and the heel 148 of the production well. Since the temperature sensor 201 in optical fiber form provides a temperature profile along the lower well, i.e. a set of values, one will preferably choose the averages of the values measured at the toe and the heel to calculate the subcool tank values at the toe 150 and the heel 148.

The obtained value is compared to threshold values parameterized by the people in charge of the facility. If the subcool tank values calculated are lower than the threshold, the automaton will act on the steam injection valves 22, 24 situated on the surface, so as to decrease the steam injection flow rate in the injection well 12. The subcool tank values along the production well are between 1° C. and 10° C., and preferably between 2° C. and 5° C.

The method can also include adjusting the distribution of the steam between the heel and the toe of the injection well 12. From the temperature profiles obtained at the production well using the sensor 201, the automaton calculates the difference between the temperature measured at the heel 148 and the temperature measured at the toe 150. The automaton compares that value to a target value, and, by acting on the steam injection valves 22 and 24 situated on the surface, adjusts the distribution of the steam injection between the heel and the toe of the injection well so as to bring it closer to the target value.

In the specific embodiment where temperature sensors 208 are installed in the injection well 12, the adjustment of the distribution of the steam between the heel and the toe of the well 12 can be done from temperature profiles obtained at the injection well. Furthermore, the automaton continuously compares the pressure measured on the surface by the sensors 210, 211 to threshold values, parameterized by the people in charge of the facility. If the measured pressure is greater than the maximum authorized pressure, the steam injection flow rate will automatically be reduced by the automaton by acting on the chokes 22 and 24.

Furthermore, a sensor 203 situated on the surface can continuously measure the pressure in the annular space 213. The suction pressure of the pump is measured by the sensor 202, or calculated from measurements done on the surface by the sensor 206. From these two values, the automaton calculates the submergence height of the pump, and compares that value to a target value parameterized by the people in charge of the facility, for example 20m. The automaton will then adjust the submergence height of the pump to said target value by acting directly on the ventilation choke 204 of the annular space. If this action does not make it possible to reach the target submergence height, the automaton will act on the speed of the pump so as to reach the target submergence height.

Furthermore, the automaton continuously compares the pressure measured by the sensor 206 upstream of the choke 124 to a maximum value parameterized by the people in charge of the facility. If the measured pressure value is greater than the threshold value, the automaton will generate an alarm, and will act on the variable drive of the pump so as to reduce the speed thereof. In fact, an excessively strong pressure increase risks damaging the surface facilities.

Furthermore, the power consumed by the pump 118 is measured continuously. The automaton compares said value to a maximum authorized power value, parameterized by the people in charge of the facility. If the measured power is greater than the maximum authorized power, the automaton will act on the variable speed drive so as to decrease the speed of rotation of the pump, which will not reach the target value.

Moreover, it is possible to consider having the automaton control the torque exerted on the pump. To that end, the automaton can continuously calculate the torque on the pump, which depends both on the speed of rotation of the pump and the consumed power. The automaton compares that value to a maximum authorized torque value, parameterized by the people in charge of the facility. If the calculated torque is greater than the maximum authorized torque, the automaton will act on the variable speed drive so as to decrease the speed of rotation of the pump. The control of the torque is particularly advantageous at the beginning of the production phase. In fact, as the tank heats up, the viscosity of the oil decreases, which decreases the torque on the pump.

The automaton can also continuously compare the steam injection flow rates measured at the steam injection valves 22, 24 of the tubes 18, 20. The measured flow rates are compared to minimum flow values, parameterized by the people in charge of the facility. If the measured values are lower than the parameterized values, the automaton will generate an alarm, and may stop the facility. In fact, the lack of steam circulation can cause the facility to freeze, thereby damaging it.

Furthermore, the automaton continuously calculates the difference between the pressure measured upon suction of the pump by the sensor 202 and the pressure measured at the heel 148 by the sensor 205, and compares that value to a threshold value parameterized by the people in charge of the facility. If the difference between these two values is greater than the threshold value, the automaton will generate an alarm and may reduce the speed of the pump. In fact, a significant difference between these two values indicates a malfunction, for example the abnormal present of sand or deposits.

The method can also include controlling a parameter consisting of the decrease speed of the pressure measured upon suction of the pump by the sensor 202. The automaton compares this speed value to a reference value parameterized by the people in charge of the facility. If this speed is greater than said reference value, the automaton will generate an alarm and may potentially decrease the speed of the pump. In fact, to prevent too much gas from being suctioned, it is not desirable to have sudden pressure variations.

The invention claimed is:

1. A method for extracting hydrocarbons from a tank comprising:

(a) providing a facility comprising:

an injection well including at least one tube for steam injection, a production well including at least one hydrocarbon extraction tube, a set of measuring sensors, at least one hydrocarbon extracting pump disposed in the production well, and an automaton controlling and monitoring operation of the facility;

(b) injecting steam into the injection well;

(c) extracting the hydrocarbons using the pump disposed in the production well; and (d) controlling speed of the pump by performing the steps of:

determining a subcool pump value based on a difference between a measured temperature at an input of the pump and an evaporation temperature calculated from a measured pressure at the input of the pump, comparing the subcool pump value with a parameterized value, decreasing the speed of the pump when the subcool pump value is lower than the parameterized value, and increasing the speed of the pump when the subcool pump value is greater than the parameterized value.

2. The method according to claim 1, further comprising keeping a set of parameters in a predetermined threshold value range by adjusting at least one of the following: (i) the speed of the pump disposed in the production well, and (ii) a steam injection flow rate of the steam into the injection well.

3. The method according to claim 2, wherein one parameter in the set of parameters is a pressure in the tank at the injection well, the method further comprising modifying the injection flow rate of the steam in the injection well.

4. The method according to claim 2, wherein one parameter in the set of parameters is a temperature difference, at a predetermined point along the production well, between the measured temperature of a fluid in the production well at the predetermined point and the evaporation temperature calculated from the measured pressure at the predetermined point, the method further comprising adjusting the steam injection flow rate of the steam in the injection well based on the controlled parameter.

5. The method according to claim 2, wherein the injection well comprises at least two steam injection tubes.

6. The method according to claim 5, wherein:

the facility also comprises temperature sensors, and the production well comprises a substantially vertical portion and a substantially horizontal portion extending from the substantially vertical portion to a toe of the production well, the substantially vertical portion and the substantially horizontal portion being connected by a heel;

one parameter of the set of parameters is the difference between the measured temperature at the heel of the production well and the measured temperature at the toe of the production well; and the method also comprising adjusting an injection distribution of the steam between the at least two steam injection tubes of the injection well.

7. The method according to claim 5, wherein the facility comprises temperature sensors disposed in the injection well, the method further comprising adjusting an injection distribution of the steam in the at least two steam injection tubes of the injection well based on temperature profiles obtained at the injection well.

8. The method according to claim 2, wherein one parameter of the set of parameters is the measured pressure in an annular space disposed around the extraction tube of the production well, the method also comprising at least one of: (i) actuating a ventilation choke disposed in fluid communication with the annular space, and (ii) varying the speed of the pump as a function of the parameter.

9. The method according to claim 2, wherein one parameter of the set of parameters is power consumed by the pump, the method further comprising varying the speed of the pump based on the parameter.

10. The method according to claim 2, wherein one parameter of the set of parameters is torque exerted on the pump calculated by the automaton from of the speed of the pump and power consumed by the pump, the method further comprising varying the speed of the pump based on the parameter.

11. The method according to claim 2, wherein the injection well includes two steam injection tubes each having a steam injection valve, the facility also comprising at least one of: (i) flow sensors, and pressure sensors situated on a first surface positioned at the steam injection valves of the two steam injection tubes of the injection well, the method further comprising:

comparing measured flow rates to parameterized minimum flow values; and at least one of: (i) triggering an alarm, and (ii) stopping the facility in response to the measured values being lower than the parameterized values.

12. The method according to claim 2, wherein the injection well comprises two steam injection tubes each with a steam injection valve, the facility also including at least one of: (i) flow sensors, and (ii) pressure sensors situated on a first surface positioned at the steam injection valves of the two steam injection tubes of the injection well, the method further comprising:

comparing measured flow rates to parameterized maximum flow values; and reducing the steam injection flow rate in response to the measured pressure being greater than the parameterized maximum pressure.

13. The method according to claim 2, wherein one parameter of the set of parameters is the difference between the measured pressure at a suction portion of the pump and a parameterized threshold pressure, the method further comprising at least one of: (i) triggering an alarm, and (ii) varying the speed of the pump based on the parameter.

14. The method according to claim 2, wherein one parameter of the set of parameters is a speed of decrease of the measured pressure at a suction of the pump, the method further comprising at least one of: (i) triggering an alarm, and (ii) varying the speed of the pump based on the parameter.

* * * * *